US008764009B2

(12) United States Patent
Philippe et al.

(10) Patent No.: US 8,764,009 B2
(45) Date of Patent: Jul. 1, 2014

(54) UNSTACKER DEVICE FOR UNSTACKING FLAT ARTICLES, WITH DETECTION OF THEIR TRACES

(75) Inventors: Agnes Philippe, Nogent sur Marne (FR); Celine Guignard, Issy les Moulineaux (FR); Hicham El Bernoussi, Paris (FR)

(73) Assignee: Solystic, Gentilly Cedex (FR)

( * ) Notice: Subject to any disclaimer, the term of this patent is extended or adjusted under 35 U.S.C. 154(b) by 787 days.

(21) Appl. No.: 12/922,268

(22) PCT Filed: Jul. 5, 2010

(86) PCT No.: PCT/FR2010/051417

§ 371 (c)(1),
(2), (4) Date: Sep. 13, 2010

(87) PCT Pub. No.: WO2011/007077

PCT Pub. Date: Jan. 20, 2011

(65) Prior Publication Data

US 2011/0129324 A1 Jun. 2, 2011

(30) Foreign Application Priority Data

Jul. 16, 2009 (FR) ..... 09 54931

(51) Int. Cl.
*B65H 7/12* (2006.01)

(52) U.S. Cl.
USPC ..... 271/262; 271/265.01; 271/265.02; 271/265.04; 271/258.01; 271/259; 271/263

(58) Field of Classification Search
USPC ..... 271/265.01–265.04, 259, 261–263, 271/258.01, 256, 264
See application file for complete search history.

(56) References Cited

U.S. PATENT DOCUMENTS 4,651,982 A * 3/1987 Martin ..... 271/4.03
4,701,094 A * 10/1987 Courjaret et al. ..... 271/11
4,867,432 A * 9/1989 Matta ..... 271/9.01

(Continued)

FOREIGN PATENT DOCUMENTS

DE 102008007010 A1 9/2008
EP 1749771 A1 2/2007

(Continued)

OTHER PUBLICATIONS

French Search Report for FR0954931 dated Mar. 11 2010.

(Continued)

*Primary Examiner* — Prasad Gokhale
(74) *Attorney, Agent, or Firm* — Sughrue Mion, PLLC

(57) ABSTRACT

The unstacker device (1) for unstacking flat articles comprises: a magazine (3) in which the articles (2) to be unstacked are disposed on edge in a stack against a jogging edge (5) and facing an unstacking plate (4) arranged to separate a first article (2A) and to drive it in a certain unstacking direction (A) that is perpendicular to the jogging edge (5); a conveyor (7) for conveying the unstacked articles, the conveyor having an inlet (7A) downstream from the jogging edge (5); and retaining means (8) disposed between the jogging edge (5) and the inlet of the conveyor (7A) and actuated to exert a retaining force on an article (2A, 2B), which retaining force opposes movement of the article. The device further comprises a detector device (9, 10) suitable for sensing and analyzing the trace of the article moving between the jogging edge and the conveyor so as to detect the presence of a plurality of articles moving together, and, on the basis of such detection, so as to actuate said retaining means for the purpose of separating said articles.

8 Claims, 5 Drawing Sheets

(56) References Cited

U.S. PATENT DOCUMENTS

| | | | | |
|---|---|---|---|---|
| 4,955,596 | A * | 9/1990 | Ricciardi | 271/110 |
| 5,290,022 | A * | 3/1994 | Sabatier et al. | 271/12 |
| 6,290,070 | B1 * | 9/2001 | Graef et al. | 209/534 |
| 6,817,610 | B2 * | 11/2004 | Rompe | 271/265.04 |
| 7,007,945 | B2 * | 3/2006 | Hiramitsu et al. | 271/125 |
| 7,905,484 | B2 * | 3/2011 | Komuro | 271/263 |
| 2007/0071284 | A1 | 3/2007 | Philippe et al. | |

FOREIGN PATENT DOCUMENTS

| | | | |
|---|---|---|---|
| EP | 1770037 | A1 | 4/2007 |
| EP | 1837296 | A2 | 9/2007 |
| JP | 2000-271542 | A | 10/2000 |
| JP | 2005-512030 | A | 4/2005 |
| JP | 2008-290124 | A | 12/2008 |
| WO | 01/70606 | A1 | 9/2001 |
| WO | 03/047773 | A2 | 6/2003 |

OTHER PUBLICATIONS

International Search Report for PCT/FR2010/051417 Oct. 21, 2010.

Office Action for Japanese Patent Application No. 2011-546931 dated Mar. 6, 2013 with English translation.

* cited by examiner

UNSTACKER DEVICE FOR UNSTACKING FLAT ARTICLES, WITH DETECTION OF THEIR TRACES

The invention relates to the field of unstacking stacks of flat articles, and in particular stacks of large-format mailpieces or "flats", such as brochures, so as to put them into series and to convey them in series in a conveyor.

The invention relates more particularly to an unstacker device for unstacking flat articles, said unstacker device comprising:

- a magazine in which the flat articles to be unstacked are disposed on edge and in a stack facing an unstacking plate and against a jogging edge, the unstacking plate being arranged to separate a first article of the stack from the other articles of the stack and to drive it in a certain unstacking direction that is substantially perpendicular to the jogging edge;
- a conveyor suitable for conveying the unstacked articles in series and on edge, the conveyor having an inlet disposed downstream from the jogging edge relative to the unstacking direction; and
- retaining means disposed substantially between the jogging edge and the inlet of the conveyor and that are actuated to exert a retaining force, e.g. a friction force or a suction force, on a face of an article moving in the unstacking direction between the jogging edge and the inlet of the conveyor, which retaining force opposes movement of said article in the unstacking direction.

Such a mailpiece unstacker device is known in which the retaining means are caused to operate systematically in response to the signal delivered by a pass sensor disposed at the inlet of the conveyor. Such an arrangement suffers from the drawback of braking the movement of all of the mailpieces, thereby adversely affecting the performance of the unstacker device. In addition, with the retaining means being actuated systematically, mailpieces of small thickness can be damaged, and mailpieces of larger thickness can be incorrectly separated.

An object of the invention is to improve an unstacker device for unstacking flat articles, and in particular flat mailpieces, so that the retaining means are actuated more effectively in order to separate mailpieces that are unstacked together, i.e. superposed mailpieces, so that they do not enter the conveyor. This makes it possible to present the mailpieces one by one at an optimum rate at the inlet of the conveyor.

To this end, the invention provides an unstacker device for unstacking flat articles, said unstacker device comprising:

- a magazine in which the flat articles to be unstacked are disposed on edge and in a stack facing an unstacking plate and against a jogging edge, the unstacking plate being arranged to separate a first article of the stack from the other articles of the stack and to drive it in a certain unstacking direction that is substantially perpendicular to the jogging edge;
- a conveyor suitable for conveying the unstacked articles in series and on edge, the conveyor having an inlet disposed downstream from the jogging edge relative to the unstacking direction; and
- retaining means disposed substantially between the jogging edge and the inlet of the conveyor and that are actuated to exert a retaining force on a face of an article moving in the unstacking direction between the jogging edge and the inlet of the conveyor, which retaining force opposes movement of said article in the unstacking direction;

said unstacker device being characterized in that it further comprises a detector device suitable for sensing the trace of each unstacked article moving between the jogging edge and the inlet of the conveyor and for analyzing said trace so as to detect the presence of a plurality of articles moving together, and, on the basis of such detection, so as to actuate said retaining means for the purpose of separating the articles that are moving together.

The trace of each unstacked article (the impression of the bottom edge of each article) can be sensed by optical means such as a linear array camera, but other types of detector may be used, e.g. a comb-shaped detector. The trace of each unstacked article can thus reveal the presence of a plurality of articles moving together, and the relative positions of the mailpieces, and therefore such a trace makes it possible, when, for example, two articles are moving together, to determine which one is ahead of the other in the unstacking direction. Such determination makes it possible to improve the control of actuation of the retaining means compared with the systematic actuation in the prior art. Tests have shown that only 60% of the situations in which mailpieces move together can be corrected by a conventional unstacker device in which the retaining means are activated systematically. With such a prior art device, when mailpieces are unstacked together, if the mailpiece that is further ahead is the one on the same side as the retaining means (the other mailpiece that is further behind being the one driven by the unstacking plate), the action of the retaining means has no effect since the mailpiece that is further ahead is already being driven by the conveyor, and can therefore no longer be separated from the mailpiece that is further behind. With the unstacker device of the invention, situations in which mailpieces are unstacked together are detected early, thereby making it possible to actuate the retaining means before the mailpieces reach the inlet of the conveyor. In addition, it is possible to consider actuating the retaining means differently depending on various configurations of the mailpiece unstacking. This early detection makes it possible to process 40% of unstacked-together mailpieces that are not handled by a prior art unstacker device.

An unstacker device of the invention may advantageously present the following features:

- a linear array camera is provided that extends transversely to said unstacking direction under the path of the unstacked objects between the jogging edge and the inlet of the conveyor so as to form an image of the trace of each unstacked article, and a data-processing unit that is arranged so that, when the presence of at least two articles that have been unstacked together is detected, it determines which of the two articles is ahead of the other one in said unstacking direction, and, on the basis of this determination, it actuates the retaining means;
- the linear camera is disposed upstream from the retaining means relative to the unstacking direction;
- first and second retaining means are provided that are disposed opposite each other about the unstacking direction;
- first and possibly second retaining means are provided that are disposed in alignment along the unstacking direction;
- each retaining means is a suction device;
- the data-processing unit is arranged to measure the thickness of each unstacked mailpiece on the basis of the image, this measurement serving to adjust the retaining force exerted by the retaining means; and the data-processing unit is arranged to detect the presence of a staple on a mailpiece on the basis of the image, this detection serving to adjust the retaining force exerted by the retaining means.

The invention is described in more detail below with reference to the accompanying drawings that show non-limiting examples of the invention, and in which.

Figure 1:
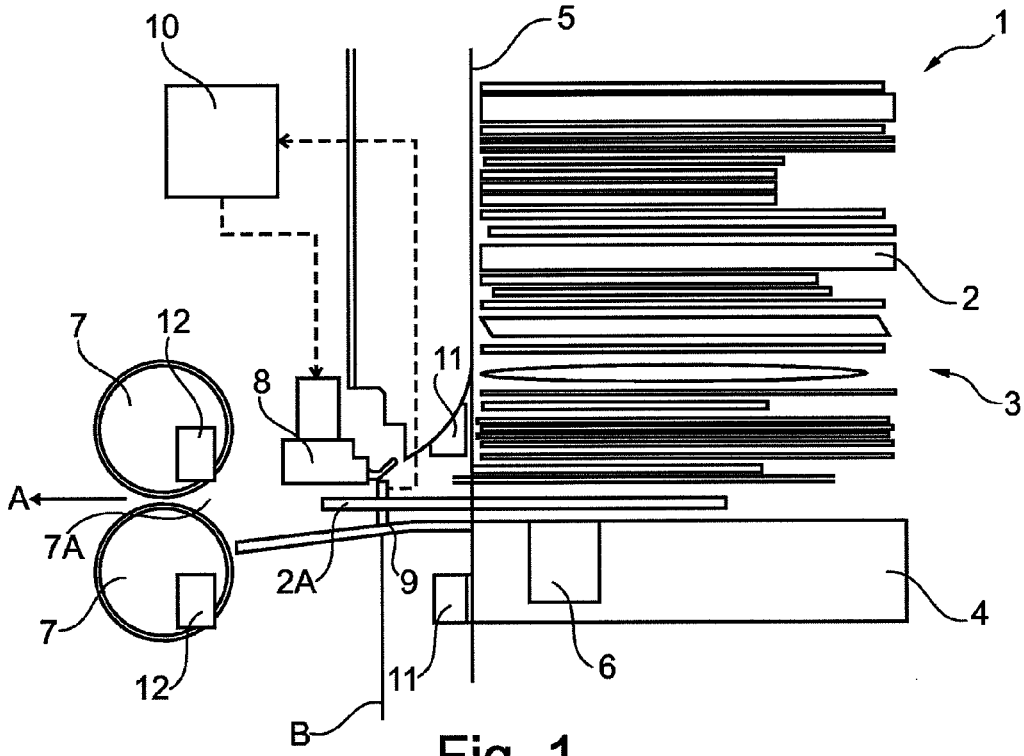
FIG. 1 is a very diagrammatic plan view of the unstacker device of the invention.

FIG. 1 is a plan view of an unstacker device 1 for unstacking flat mailpieces 2, said unstacker device including a magazine 3 in which the mailpieces 2 to be unstacked are disposed on edge in a stack facing an unstacking plate 4 and against a jogging edge 5 that is substantially perpendicular to the unstacking plate 4.

On the unstacking plate 4, there are disposed drive means 6, e.g. a perforated belt co-operating with an unstacking solenoid valve, suitable for driving the first mailpiece 2A of the stack to be unstacked 2 that faces the unstacking plate 4 in a certain unstacking direction indicated by the arrow A, parallel to the unstacking plate 4 and perpendicular to the jogging edge 5.

As shown in FIG. 1, the unstacker device 1 further includes a conveyor 7, operating, in this example, by nipping, shown in this example in the form of two opposing motor-driven pulleys forming the inlet 7A of the conveyor. The inlet 7A is, in general, referred to as the "nip point" of the unstacker device. It is disposed downstream from the unstacking plate 4 in the unstacking direction A. Between the inlet 7A of the conveyor and the jogging edge 5, in the unstacking direction A, there are provided retaining means 8, e.g. a suction nozzle 8, and a detector device 9.

The retaining means 8 are disposed on one side of the path of the mailpieces in the direction A so as to exert a retaining force on a mailpiece moving between the jogging edge and the inlet of the conveyor, said retaining force opposing movement of said mailpiece in the unstacking direction A. As explained below, the unstacker device of the invention may, for example, include two retaining means mutually opposite about the unstacking direction A, i.e. disposed on either side of the path of the mailpieces between the jogging edge and the inlet of the conveyor, or indeed two or more retaining means lined up on the same side of the path of the mailpieces.

The detector device 9 comprises an optical device that, in this example, is a linear array camera 13 of the charge-coupled device (CCD) type, disposed under the path of the mailpieces between the jogging edge 5 and the inlet 7A. Preferably, the camera 13 is placed in the vicinity of the jogging edge 5 and upstream from the retaining means 8 relative to the unstacking direction A so as to enable mailpieces that are moving together to be detected early. The linear array camera 13 extends transversely to the unstacking direction A so as to sense an image of the trace of each mailpiece moving between the jogging edge 5 (or the unstacking plate 4) and the inlet 7A of the conveyor. The image may, in particular, be a digital grayscale image. As indicated above, instead of using the camera 13, it is possible, for example, to use a sensor of the tactile comb type that is sensitive to the weight of the mailpiece.

Between the unstacking plate 4 and the conveyor 7, pass sensors 11, 12 may be provided, e.g. photocells, each of which comprises an emitter and a receiver. In particular, a first sensor 11 is disposed at the jogging edge 5 for detecting the leading edge of each mailpiece as soon as it leaves the unstacking plate. A second sensor 12 is disposed at the inlet 7A of the conveyor for detecting the leading edge of each mailpiece arriving at the inlet 7A of the conveyor.

Figure 2:
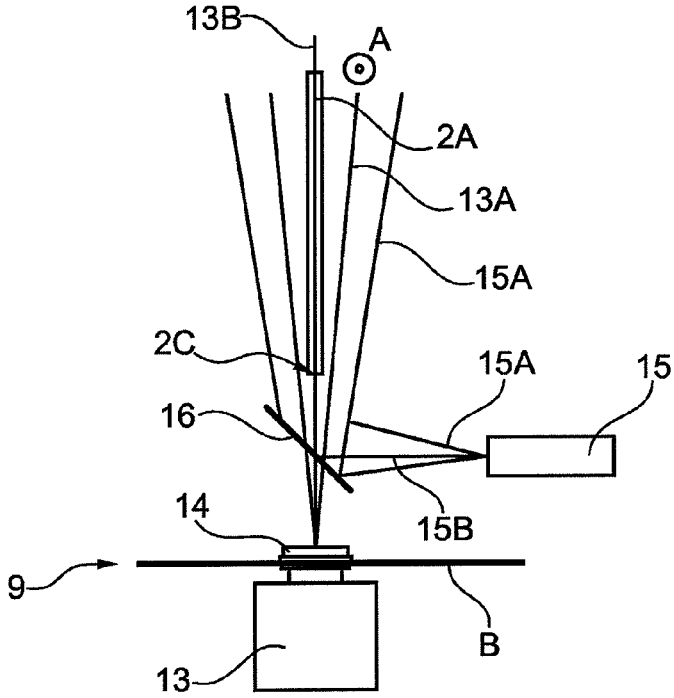
FIG. 2 shows an optical device for sensing the traces of the bottom edges of the mailpieces in accordance with the invention.

FIG. 2 shows, in detail, the optical device 9 that comprises the CCD-type linear array camera 13, accompanied by a suitable lens 14 and by a lighting device 15 delivering a light beam 15A and constituted, in this example, by a laser diode with a line generator. The camera 13 has a width of field of vision 13A that is directed such that its axis 13B or line of sight is perpendicular to the unstacking direction A, so as to sense the bottom edge of each mailpiece. The line of acquisition of the camera 13 thus extends substantially perpendicularly to the edge of the mailpiece 2A, in a horizontal direction that is perpendicular to the unstacking direction A, and that is indicated by arrow B in FIG. 2. The camera 13 thus forms a linear image continuously as the mailpiece, such as the mailpiece 2A, is moving past the camera in the unstacking direction A. The linear images that are acquired successively are juxtaposed in a memory so as to form a two-dimensional image of the bottom edge 2C of the mailpiece 2A.

In order to increase the compactness of the detector device 9 so as to make it easier to incorporate mechanically into the unstacker device 1, the axis 15B of the lighting device 15 extends substantially perpendicularly to the axis 13B of the camera 13, and a beam splitter 16 is provided to position the lighting in such a manner as to align it with the axis 13B of the camera 13. The beam splitter 16 (e.g. a plate) is thus positioned both at about 45° relative to the axis 13B of the camera 13 and also at about 45° relative to the axis 15B of the lighting device 15 so as to deflect the light beam 15A. The camera 13 thus acquires images of the mailpiece 2A through the beam splitter 16. Such a lighting device 15 with a beam splitter 16 makes it possible to increase the depth of field of the detector device 9 while improving the lighting of the mailpiece 2A.

The camera 13 is preferably a 512-pixel linear array sensor, and the resolution of the acquired images may be about 16 pixels per millimeter (mm) in the direction B, representing the limit for being able to detect a mailpiece 2A or a gap between two mailpieces of thickness less than 0.1 mm. The frequency of acquisition, at a speed of about 2.4 meters per second (m/s), results in a resolution of about 4 pixels per millimeter or 4 rows per millimeter. In a variant, the camera 13 may be a matrix array camera that acquires a two-dimensional image of the edge of the mailpiece 2A directly.

The camera 13 may be positioned at a slot provided in the sole of the unstacker between the unstacking plate and the conveyor. It should be far enough away from the jogging edge 5 to avoid sensing the image of a mailpiece awaiting unstacking in the magazine 3, but near enough for the retaining means 8 to be actuated in real time through a data-processing unit 10. As described below, the unit 10 is arranged to analyze the image of the trace of a mailpiece in order to detect the presence of a plurality of mailpieces unstacked together in a bunch, and thus to count the number of mailpieces and to determine their relative positions and, when a plurality of mailpieces are detected, to actuate the retaining means 8.

Figure 3A:
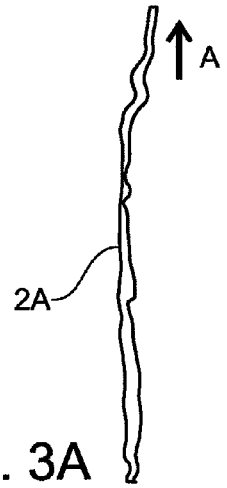
FIG. 3A shows a grayscale (GS) image of a mailpiece on its own, obtained by a detector device of the invention.
Figure 3B:
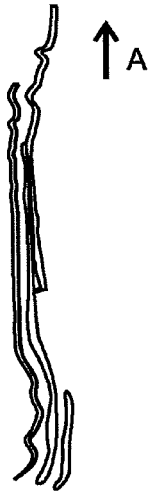
FIG. 3B shows a grayscale image of a plurality of mailpieces unstacked together in a bunch, the image being obtained by a detector device of the invention.
Figure 3E:
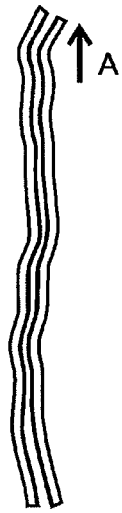
FIG. 3E shows a grayscale image of two mailpieces, the leading edges of both mailpieces lying at the same abscissa value, and the image being obtained by a detector device of the invention.
Figure 3C:
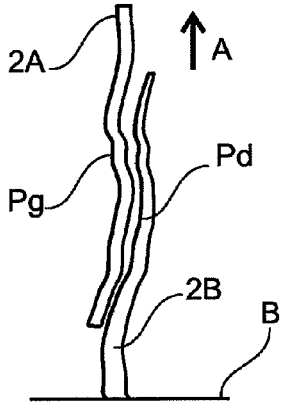
FIG. 3C shows a grayscale image of two mailpieces, the left mailpiece being ahead of the right mailpiece, and the image being obtained by a detector device of the invention.
Figure 3D:
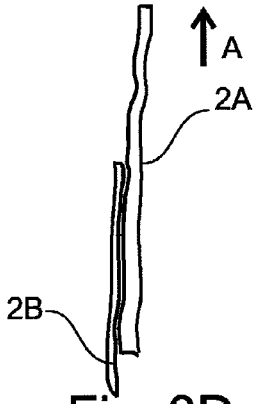
FIG. 3D shows a grayscale image of two mailpieces, the right mailpiece being ahead of the left mailpiece, and the image being obtained by a detector device of the invention.

FIGS. 3A to 3E show examples of grayscale images formed by means of the camera 13. The image in FIG. 3A shows a single trace. The image in FIG. 3B shows four traces and therefore the presence of a plurality of mailpieces unstacked together in a bunch. The images in FIGS. 3C and 3D show two traces and therefore also the presence of a plurality of mailpieces unstacked together in a bunch. Overall, it is possible to distinguish between four types of unstacking configuration. The mailpiece is said to be of the "standard" or "S" type if it is unstacked on its own (FIG. 3A). When at least two mailpieces are unstacked together, the mailpiece is said to be of the "positive" or "P" "non-standard" or "nS" type if the leading edge of the left mailpiece in the conveying direction A is ahead of the leading edge of the right mailpiece, as can be seen in FIG. 3C; and the mailpiece is said to be of the "negative" or "N" "nS" type if the leading edge of the right mailpiece in the conveying direction A is ahead of the left mailpiece, as can be seen in FIG. 3D. Finally, if the leading edges of the two mailpieces that are unstacked together coincide exactly (i.e. if they have the same abscissa value along the conveying direction A), the mailpiece is said to be "perfect" or "Pf" "nS", as shown in FIG. 3E.

In the configuration of the unstacker device 1 shown in FIG. 1, if the first two mailpieces in the stack 2 are unstacked together in a bunch, the first mailpiece in the stack is then positioned on the left in the conveying direction A, and the second mailpiece on the right. It can be understood that a mailpiece of the positive type corresponds to the configuration in which the leading edge of the first mailpiece in the stack is ahead of the leading edge of the second mailpiece. This is the configuration that is most frequently observed because it represents about 75% of non-standard mailpieces. The retaining means 8 have thus been placed on the right side relative to the conveying direction A so as to retain the second mailpiece, which is behind in the majority of cases. Naturally, it can be understood that in an unstacker device configuration that is symmetrical relative to the configuration shown in FIG. 1, the positive-type mailpiece then corresponds to a right mailpiece ahead of the left mailpiece.

The processing unit 10 is thus arranged so as to determine, when mailpieces are unstacked together, the type of the mailpiece S, P, N, or Pf, and thus so as to control the retaining means 8 appropriately.

Figure 4:
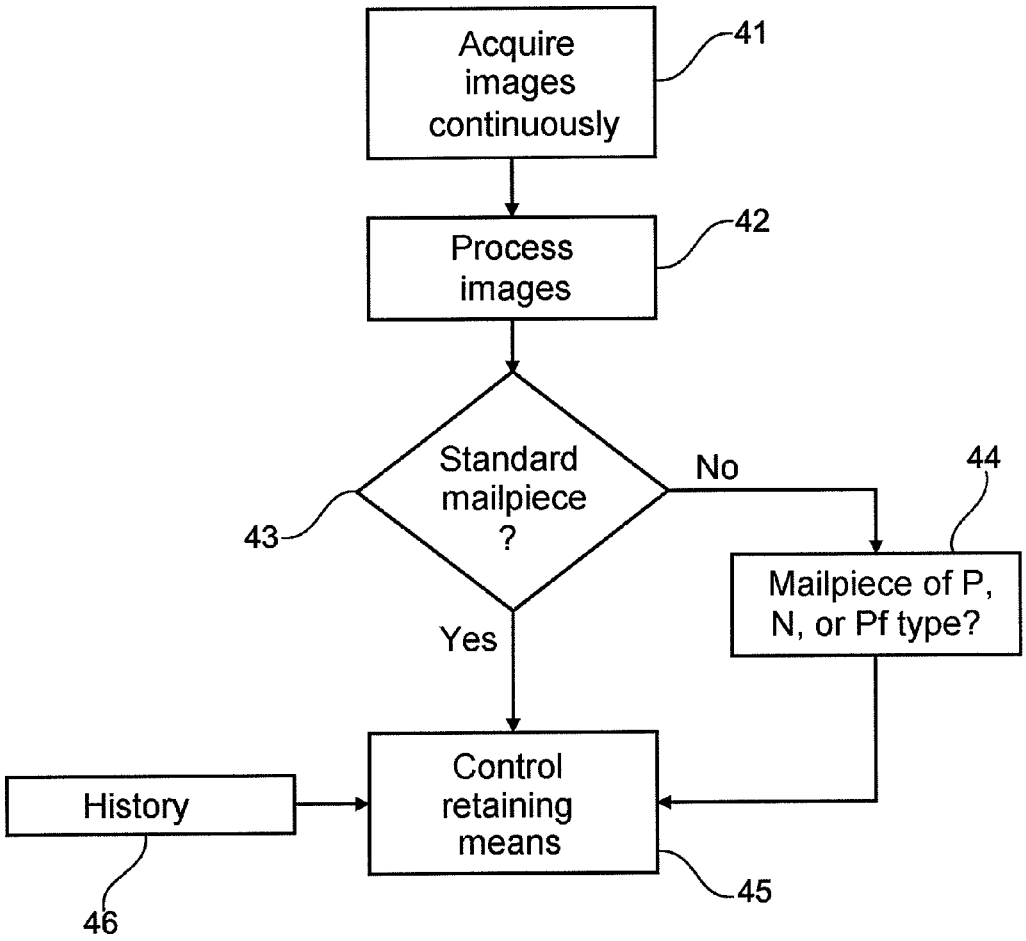
FIG. 4 is a flow chart showing the detection process of the invention.

FIG. 4 shows how the retaining means 8 are controlled. In step 41, successive GS linear images are formed continuously of the bottom edge of each mailpiece as soon as it is detected by the sensor 11, for example, and as said mailpiece is moved in the direction A. In a variant, sensing and analysis of the images of the edges of the mailpieces may be limited to the length of time of the unstacking cycle, i.e. they are triggered at the same time as activation of the drive means 6, and they are stopped a determined lapse of time after deactivation of said drive means. Due to the high speed of the unstacked mailpieces (about 2.4 m/s), the time allotted to processing images by the unit 10 for managing the information given by the traces of the unstacked mailpieces can be less than 10 milliseconds (ms) depending on the configuration of the unstacker device 1. In order to satisfy this real-time constraint, the unit 10 analyses partial images in two dimensions containing a limited number of acquisition rows, e.g. 32 rows in this example, which corresponds to about a length of 8 mm for an unstacked mailpiece. Each partial image thus comprises 32 rows and 512 columns of GS pixels.

The analysis may also be performed on partial images of 32 columns with a sliding window, e.g. a window that slides four columns by four columns so as to have an overlap between successive images and so as to refresh the analysis every 4 columns of image acquisition, i.e. every millimeter of advance of the mailpieces.

The two-dimensional partial image is formed in a memory in step 42 and is analyzed in step 43 so as to determine whether a plurality of mailpieces are being unstacked together and so as to determine the number of mailpieces present. During this analysis, the current mailpiece(s) continue to move in the direction A, and it is possible to estimate that two acquisition rows are lost, corresponding to a length of 0.5 mm of the trace of the mailpiece before complete refreshing of the partial image. When a plurality of mailpieces are detected, the processing continues with determination of the type of mailpiece S, or P, N, or Pf non-standard in step 44 so as to control the retaining means 45 while possibly taking account of a history at 46 as described below.

Figure 6:
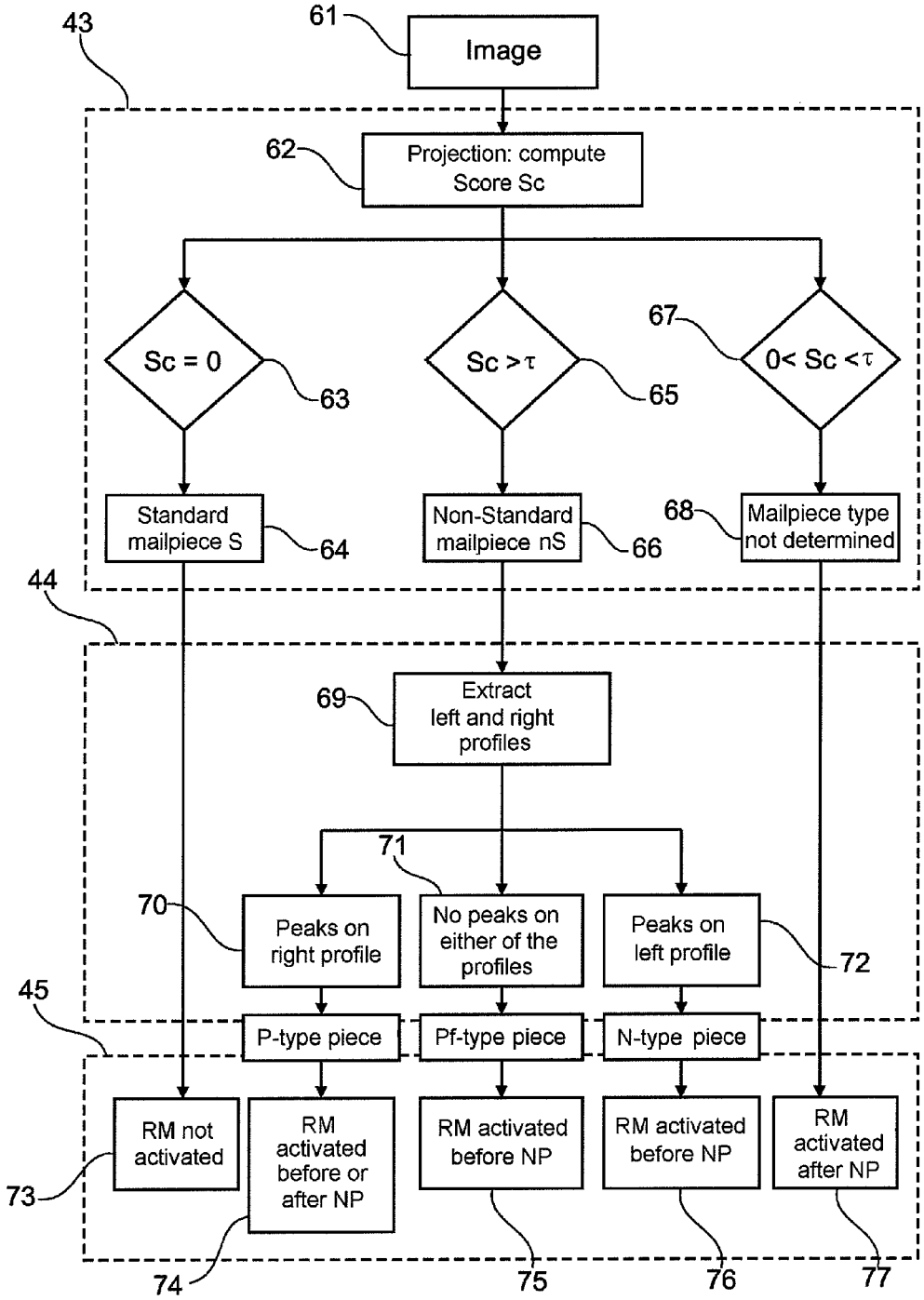
FIG. 6 is a flow chart showing how the retaining means of the invention are controlled.

Steps 43 and 44 are shown in more detail in FIG. 6.

Figure 5A:
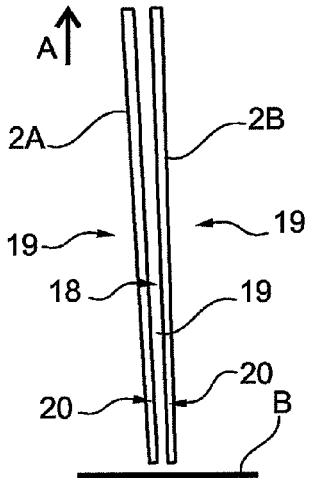
FIG. 5A shows another grayscale image of two mailpieces obtained by a detector device of the invention.

In step 61, a partial image is built in a memory. Image analysis consists in determining the number of unstacked-together mailpieces visible in said image. For this purpose, use is made of the fact that there exists a space 18 of magnitude that can vary between the traces of a plurality of mailpieces in the image, as can be seen in FIG. 5A.

In the image, this results in an alternation of dark zones 20 (the traces of the mailpieces) and of pale zones 19 (around the mailpieces and space 18). The number of transitions between a dark zone and a pale zone in the direction B is a robust characteristic making it possible to determine mailpiece type. Naturally, it can be understood that, depending on the imaging convention that is chosen, the space 18 could, conversely, correspond to a dark zone and the mailpieces could correspond to pale zones.

Figure 5B:
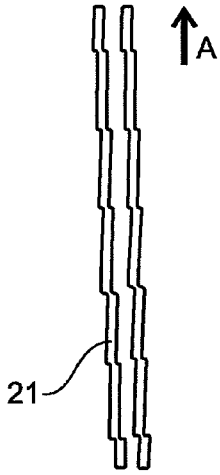
FIG. 5B shows a projection of the grayscale image of FIG. 5A.

In order to count the number of transitions in an image in step 62, firstly the image is subdivided in the direction B into strips 21 of fixed size as can be seen in FIG. 5B. Then, a projection of the grayscale levels is computed on each strip 21, i.e. the mean of the grayscale levels of the pixels is computed per column of the GS image strip so that the rows of a strip all have the same values after projection. In this way, the GS image is smoothed, thereby making the method of detecting the number of mailpieces present less sensitive to noise. It can be understood that the width of the strips is chosen appropriately: a small strip width leads to a projection signal that is too noisy and subject to local variations. Conversely, a strip width that is too wide smoothes the signal and attenuates the characteristic peaks of the bimodal distributions (dark/pale zones). In addition, an overly wide strip can be misleading for the method when the mailpiece is a curved standard mailpiece (see FIG. 3A, top of the mailpiece).

Then, for each strip 21, a search is made for the number of extrema in terms of grayscale levels that correspond to dark/pale transitions. As is known, searching for extrema can firstly consist in searching for local maxima and minima, and then, if the local maxima or minima are not very different or too similar, they are rejected, until a minimum is found that is situated between two maxima for detecting two mailpieces. Then, computation is performed that is representative of the mean number Sc of transitions for the entire image portion using the following relationship:

$$Sc = \frac{\text{number of transitions}}{\text{number of strips}} - 1$$

It can be understood that Sc generally lies in the range 0 for a mailpiece S that is unstacked on its own to 1 for two bunched-together mailpieces. However, in practice, Sc may be greater than 1 when three or more mailpieces have been unstacked together. The score Sc can be likened to the concept of degree of belonging to fuzzy subsets. Delivering as output a fuzzy degree of belonging constitutes a major advantage of this approach, because it makes it possible to go from one mailpiece S to a plurality of unstacked-together mailpieces continuously, thereby avoiding threshold effects.

On the basis of the mean number Sc of transitions, firstly, for a current unstacked mailpiece, it is determined whether it belongs to one of the two categories constituted by the S type and by the nS type merely by thresholding on the score Sc. Thus, the mailpieces for which Sc is zero (step 63) are declared to be of the S type at 64, and the mailpieces for which Sc is greater than a certain threshold $\tau$ (step 65) are declared to be of the nS type at 66 (i.e. all of the mailpieces that it can be certain are not of the S type). The mailpieces for which Sc lies in the range 0 to $\tau$ (step 67) have an equal chance of belonging to either of the types (S or nS). This range of values Sc is a zone of uncertainty for the method that corresponds to an ambiguous classification of the mailpieces at 68. The threshold $\tau$ is thus chosen so as to obtain a good compromise between sorting to incorrect directions (generated by nS-type mailpieces that are detected as being S-type mailpieces) and S-type mailpieces being detected incorrectly as being nS-type mailpieces.

If the mailpieces have been declared to be of the nS type with a confidence rating that is sufficiently reliable in step 66, the method continues in step 44 with a labeling algorithm designed to determine the types of the mailpieces that are unstacked together, namely positive, negative, or perfect.

In step 69, the labeling algorithm consists in extracting left and right profiles of the mailpiece from the GS image, and then in analyzing said profiles for the purpose of detecting peaks. A left profile Pl(i) of the current mailpiece is defined as being the set of the first pixels having a grayscale level greater than a certain threshold $\sigma$ when each row of the GS image is scanned from left to right in the direction B perpendicular to the conveying direction A as indicated in FIG. 3C:

$Pl(i)=\text{Min}\{j/\text{image}[i,j]>\sigma\}$ where $\underline{i}$ and $\underline{j}$ are the co-ordinates of each pixel, $\underline{i}$ designating the row position index and $\underline{j}$ designating the column position index, and image[i,j] is the value of the pixel of co-ordinates (i,j) in the GS image.

In the same way, a right profile Pr(i) is defined as being the set of the last pixels having a grayscale level greater than the threshold $\sigma$ in the direction B perpendicular to the conveying direction A as indicated in FIG. 3C:

$$Pr(i)=\text{Max}\{j/\text{image}[i,j]>\sigma\}$$

It can be understood that the threshold $\sigma$ may be different for defining the left profile or the right profile, for example so as to take account of shadow phenomena.

The labeling algorithm continues by defining left and right peaks in the profiles as being local extrema of the respective functions $|Pl(i+1)-Pl(i)|$ for the left profile and $|Pr(i+1)-Pr(i)|$ for the right profile.

Finally, depending on whether peaks are present in or absent from the profiles, the algorithm labels the mailpieces in the following manner:

- when peaks are present on the left profile, the mailpiece is declared to be of the N type in step 72 (FIG. 3D);
- when peaks are absent, the mailpiece is declared to be of the Pf type in step 71 (FIG. 3E); and
- when peaks are present on the right profile, the mailpiece is declared to be of the P type in step 70 (FIG. 3C).

Then, depending on the result obtained, and based on a history of previous decisions 46, the unit 10 activates or does not active the retaining means 8 in step 45:

- in step 73, when the mailpiece is of the standard S type (FIG. 3A), the retaining means 8 (indicated by the reference RM in FIG. 6) are not activated;
- in step 74, when the mailpiece is of the P type (FIG. 3C), the retaining means 8 can be activated, as a function of the thickness of the mailpiece, either before or after the mailpiece 2A is detected by the sensor 12 at the nip point 7A (indicated by the reference NP in FIG. 6), i.e. the mailpiece that is further ahead (the left mailpiece) is nipped by the mailpiece conveyor 7 and the right mailpiece is retained by the retaining means 8, thereby separating it from the left mailpiece and avoiding jamming of the mailpiece conveyor 7;
- in step 76, when the mailpiece is of the N type (FIG. 3D), the retaining means 8 are activated before the mailpiece 2A is detected by the sensor 12 at the nip point 7A, i.e. the mailpiece that is further ahead (the right mailpiece) is retained by the retaining means 8, and the left mailpiece is unstacked and nipped by the mailpiece conveyor 7, thereby separating the two mailpieces and avoiding jamming of the mailpiece conveyor 7;
- in step 75, when the mailpiece is of the Pf type (FIG. 3E), activation is the same as for an N-type mailpiece, i.e. the retaining means 8 are activated before the mailpiece 2A is detected by the sensor 12 at the nip point 7A, i.e. the right mailpiece is retained by the retaining means 8, and the left mailpiece is nipped by the mailpiece conveyor 7;
- in step 77, when there is uncertainty about the mailpiece classification, the retaining means 8 are activated systematically after the mailpiece(s) is/are detected by the sensor 12, i.e. after reaching the nip point 7A. This corresponds to the retaining means 8 operating in the prior art manner.

The history of the decisions 46 enables the unit 10 to monitor the movement of the mailpieces and to adapt the activation over time, until the mailpieces are driven in the conveyor 7. For example, when mailpieces are labeled as P type or N type on the basis of a first image, the next image gives a "Pf-type" result corresponding to the place where two mailpieces are superposed without it being necessary to trigger corresponding actuation of the retaining means 8.

The advantage procured by the unstacker device 1 of the invention is twofold. Firstly, incorrect activation of the retaining means 8 when S-type mailpieces are present is minimized, thereby reducing the risk of damaging the mail and improving the throughput rate of the unstacker device 1. Secondly, when a non-standard mailpiece is present, activation of the retaining means 8 at the appropriate time makes it possible to avoid simultaneously driving a plurality of mailpieces in the conveyor 7.

In FIG. 6, it should be understood that after step 45, the process loops back to the step 61 for a new image (or a portion of image of 32 rows, for example).

Figure 7:
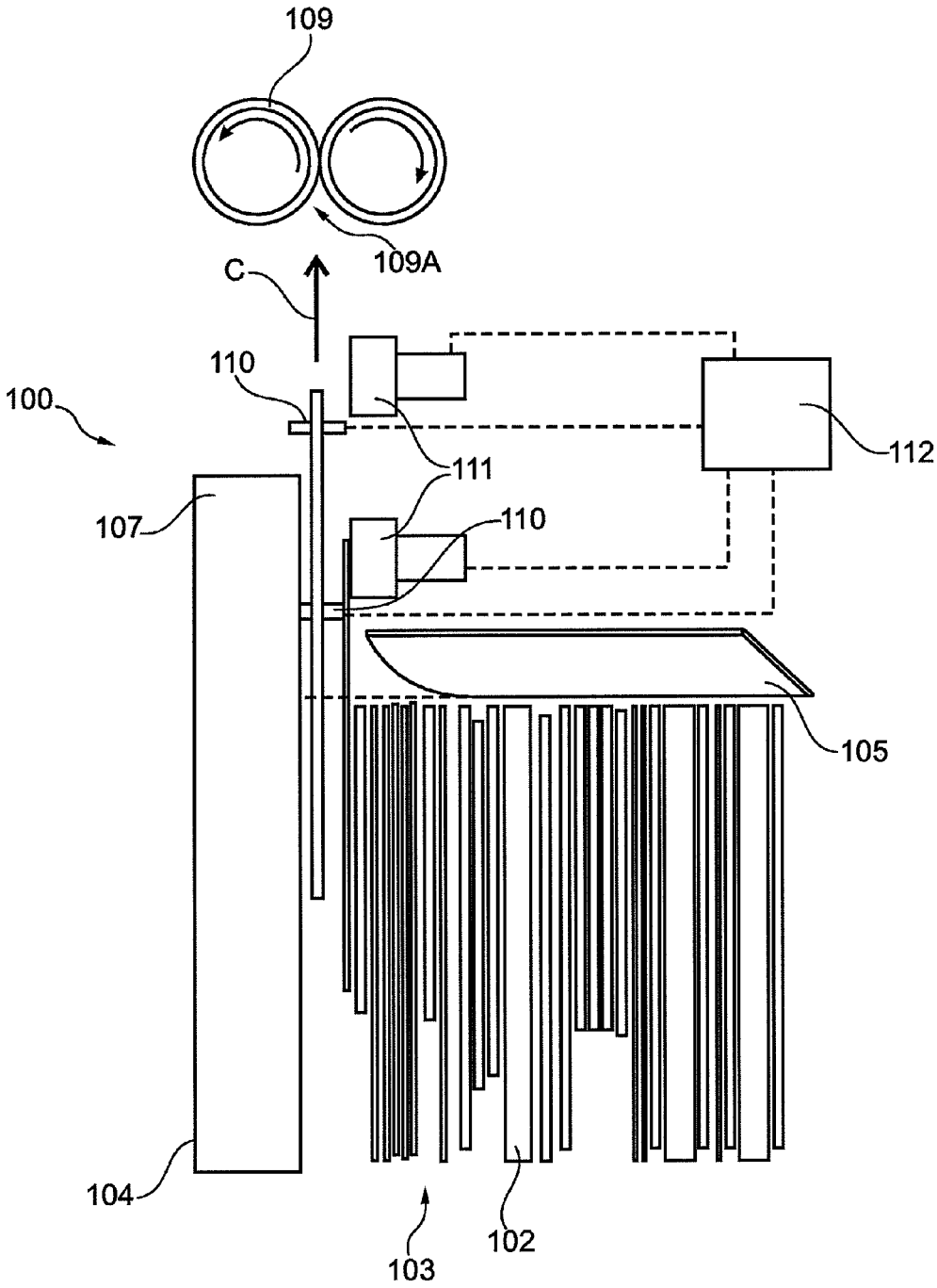
FIG. 7 is a very diagrammatic plan view of another embodiment of the unstacker device of the invention.

FIG. 7 shows another unstacker device 100 for unstacking flat mailpieces 102. The device 100 includes a magazine 103 in which the mailpieces 102 to be unstacked are disposed on edge in a stack facing an unstacking plate 104 and against a jogging edge 105. The unstacker device 100 further includes a mailpiece conveyor 109 for conveying mailpieces by nipping them and having its inlet 109A or nip point shown in this example in the form of two opposing pulleys. Between the unstacking plate and the nip point there are disposed drive means 107 for driving the mailpieces 102 in an unstacking direction C.

As shown in FIG. 7, the unstacker device 100 is, in this example, equipped with a detector device having two cameras 110 spaced apart in the unstacking direction C and designed to acquire images of the bottom edges of the mailpieces 102. In addition, successive retaining means 111 disposed in alignment along the unstacking direction C. It is also possible to provide a plurality of successive retaining means 111.

In the unstacker device 100, the two cameras 110 make it possible to monitor in real time the action of the drive means 107 and of the retaining means 111, and, as a function of the result of said action, to control in real time each of the retaining means 111 through a data-processing unit 112. For example, when a plurality of mailpieces are unstacked together, the two retaining means 111 can be controlled selectively in different manner so as either to brake or not to brake a particular mailpiece.

It is to be understood that the description of the embodiments above is in no way limiting on the invention. For example, it is possible to dispose two or more retaining means 8 face to face, in mutual opposition in the conveying direction A, in order to improve the retention of conveyed-together mailpieces and in order to improve the organization of the mailpieces in succession in the unstacking direction C.

In addition, the method of the invention may incorporate measuring the thickness of each mailpiece and/or the speed of movement of the mailpieces and/or the relative movement of the mailpieces that have been unstacked together so as to determine the effectiveness with which the mailpieces are retained and thus the effectiveness with which they are separated, and so as to adjust the retaining force as appropriate. Thus, it is possible to adjust the retaining force applied to the mailpieces by the retaining means so as to take account of the relative fragility of each mailpiece.

It is also possible, on the basis of the GS images of the mailpieces, to determine whether or not staples are present on the edge of a mailpiece, indicating whether the mailpiece is an open one (with staples) or a closed one (without staples), and making it possible to adjust the retaining force applied to the mailpiece so as to avoid damaging open mailpieces.

The invention claimed is:

1. An unstacker device (1; 100) for unstacking flat articles, said unstacker device comprising:

a magazine (3; 103) in which the flat articles (2; 102) to be unstacked are disposed on edge and in a stack facing an unstacking plate (4; 104) and against a jogging edge (5; 105), the unstacking plate (4; 104) being arranged to separate a first article (2A) of the stack from the other articles (2, 102) of the stack and to drive it in a certain unstacking direction (A; C) that is substantially perpendicular to the jogging edge (5; 105);

a conveyor (7; 109) suitable for conveying the unstacked articles in series and on edge, the conveyor having an inlet (7A; 109A) disposed downstream from the jogging edge (5; 105) relative to the unstacking direction (A; C); and retaining means (8; 111) disposed substantially between the jogging edge (5; 105) and the inlet of the conveyor (7A; 109A) and that are actuated to exert a retaining force on a face of an article (2A, 2B) moving in the unstacking direction (A; C) between the jogging edge (5; 105) and the inlet of the conveyor (7A; 109A), which retaining force opposes movement of said article in the unstacking direction (A; C), said unstacker device being characterized in that it further comprises a detector device (9, 10; 110, 112) suitable for sensing the trace of each unstacked article moving between the jogging edge (5; 105) and the inlet of the conveyor (7A; 109A) and for analyzing said trace so as to detect the presence of a plurality of articles moving together, and, on the basis of such detection, so as to actuate said retaining means (8; 111) for the purpose of separating the articles that are moving together and comprising a linear array camera (9, 110) extending transversely to said unstacking direction under the path of the unstacked objects between the jogging edge (5; 105) and the inlet of the conveyor (7A; 109A) so as to form an image of the trace of each unstacked article, and a data-processing unit (10; 112) that is arranged so that, when the presence of at least two articles that have been unstacked together is detected, it determines which of the two articles is ahead of the other one in said unstacking direction (A; C), and, on the basis of this determination, it actuates the retaining means (8; 111), wherein the data-processing unit (10; 112) is arranged to detect the presence of a staple on a mailpiece on the basis of the image, this detection serving to adjust the retaining force exerted by the retaining means.

2. A device according to claim 1, wherein the linear camera is disposed upstream from the retaining means (8; 111) relative to the unstacking direction (A; C).

3. An unstacker device according to claim 1, including first and second retaining means disposed opposite each other about the unstacking direction.

4. An unstacker device according to claim 1, including first and second retaining means (111) disposed in alignment along the unstacking direction (C).

5. An unstacker device according to claim 1, in which device each retaining means (8; 111) is a suction device.

6. A device according to claim 1, wherein the data-processing unit (10; 112) is arranged to measure the thickness of each unstacked mailpiece on the basis of the image, this measurement serving to adjust the retaining force exerted by the retaining means.

7. A device according to claim 1, including a plurality of linear array cameras (110) spaced apart in said unstacking direction (C).

8. A mail-handling machine including an unstacker device (1; 100) according to claim 1.

* * * * *